US010843889B2

(12) United States Patent
Allen, Jr. et al.

(10) Patent No.: US 10,843,889 B2
(45) Date of Patent: Nov. 24, 2020

(54) STACKER HOPPER WITH FEED INTERRUPT

(71) Applicant: A. G. Stacker, Inc., Weyers Cave, VA (US)

(72) Inventors: Clarence C. Allen, Jr., Mt. Crawford, VA (US); Eric H. Crowe, Weyers Cave, VA (US); Micah C. Sundstrom, Staunton, VA (US); Eric Stempihar, Rockingham, VA (US); Kevin G. Gorby, Harrisonburg, VA (US); Dalton Hege, Weyers Cave, VA (US)

(73) Assignee: A.G. STACKER INC., Weyers Cave, VA (US)

( * ) Notice: Subject to any disclaimer, the term of this patent is extended or adjusted under 35 U.S.C. 154(b) by 106 days.

(21) Appl. No.: 16/033,543

(22) Filed: Jul. 12, 2018

(65) Prior Publication Data

US 2018/0319614 A1 Nov. 8, 2018

Related U.S. Application Data

(63) Continuation-in-part of application No. 15/354,671, filed on Nov. 17, 2016, now Pat. No. 10,329,114.
(Continued)

(51) Int. Cl.
*B65H 31/34* (2006.01)
*B65H 29/34* (2006.01)
(Continued)

(52) U.S. Cl.
CPC ..... *B65H 29/34* (2013.01); *B65H 29/247* (2013.01); *B65H 31/10* (2013.01);
(Continued)

(58) Field of Classification Search
CPC ..... B65H 29/34; B65H 29/247; B65H 31/10; B65H 31/3009; B65H 31/3054; B65H 31/32; B65H 31/38; B65H 2301/5122
(Continued)

(56) References Cited

U.S. PATENT DOCUMENTS 3,298,683 A * 1/1967 Stroud ..... B65H 31/34 271/218
3,379,320 A * 4/1968 Loach ..... B65H 33/08 414/788.3
(Continued)

FOREIGN PATENT DOCUMENTS

DE 3122451 C2 2/1985

*Primary Examiner* — Thomas A Morrison
(74) *Attorney, Agent, or Firm* — J-Tek Law PLLC; Jeffrey D. Tekanic; Scott T. Wakeman

(57) ABSTRACT

A sheet stacking system includes a conveyor for carrying sheets from a conveyor intake end to a conveyor discharge end and a hopper at the discharge end for receiving the sheets and guiding them as they fall in a cascade path onto a platform. The hopper has a backstop facing the discharge end of the conveyor and a first accumulator that includes a carrier and a support extending from the carrier through the backstop. The support is configured to rotate from a retracted position to an extended position relative to the backstop, and the carrier is movable linearly and vertically relative to the backstop with the support in the extended position from a raised location with the support outside the cascade path to a lowered location with the support in the cascade path.

15 Claims, 12 Drawing Sheets

Related U.S. Application Data

(60) Provisional application No. 62/534,741, filed on Jul. 20, 2017, provisional application No. 62/256,421, filed on Nov. 17, 2015.

(51) Int. Cl.

| | |
|---|---|
| ***B65H 31/10*** | (2006.01) |
| ***B65H 31/38*** | (2006.01) |
| ***B65H 31/30*** | (2006.01) |
| ***B65H 31/32*** | (2006.01) |
| ***B65H 29/24*** | (2006.01) |

(52) U.S. Cl.
CPC ..... *B65H 31/3009* (2013.01); *B65H 31/3054* (2013.01); *B65H 31/32* (2013.01); *B65H 31/38* (2013.01); *B65H 2301/5122* (2013.01); *B65H 2701/1762* (2013.01)

(58) Field of Classification Search
USPC .... 414/789.9, 790, 791.1, 790.3, 791.2, 792
See application file for complete search history.

(56) References Cited

U.S. PATENT DOCUMENTS

| | | | | |
|---|---|---|---|---|
| 4,311,475 | A * | 1/1982 | Imai | B42C 19/08 493/142 |
| 4,359,218 | A | 11/1982 | Karis | |
| 4,796,879 | A | 1/1989 | Martini et al. | |
| 4,938,657 | A | 7/1990 | Benson et al. | |
| 5,368,288 | A | 11/1994 | Philipp et al. | |
| 5,370,382 | A | 12/1994 | Wetter | |
| 5,545,001 | A | 8/1996 | Capdeboscq | |
| 6,446,962 | B1 | 9/2002 | Taffertshofer | |
| 6,641,358 | B2 * | 11/2003 | Schmidt, V | B65H 31/3009 198/431 |
| 8,240,652 | B2 | 8/2012 | Matteis | |
| 2004/0188926 | A1 | 9/2004 | Tamura | |
| 2004/0227282 | A1 | 11/2004 | Grewe et al. | |
| 2008/0251984 | A1 | 10/2008 | Caron et al. | |
| 2012/0132091 | A1 | 5/2012 | Wyss | |
| 2016/0145072 | A1 | 5/2016 | Allen et al. | |

* cited by examiner

STACKER HOPPER WITH FEED INTERRUPT

CROSS-REFERENCE TO RELATED APPLICATIONS

The present application is a continuation-in-part of U.S. patent application Ser. No. 15/354,671, filed Nov. 17, 2016, and claims the benefit of U.S. Provisional Patent Application No. 62/534,741, filed Jul. 20, 2017, and the entire contents of these applications are hereby incorporated by reference.

TECHNOLOGICAL FIELD

The present disclosure is directed to an accumulator for a hopper of a sheet stacking system, and to a method of operating the accumulator, and, more specifically, to a sheet stacking system having a hopper with an accumulator configured to interrupt a cascading flow of sheets exiting a conveyor and to support a partial stack of sheets while a main stack of previously deposited sheets is removed from beneath the accumulator.

BACKGROUND

A conventional stacking apparatus 10 is illustrated in FIG. 1. The stacking apparatus 10 is configured for use adjacent to a rotary die cut machine 12 which cuts blanks (not illustrated) from sheets of material, for example, corrugated paperboard. The stacking apparatus 10 includes a receiving or "layboy" section 14 that receives the blanks from the die cut machine 12 and discharges them onto a transfer conveyor 16. The transfer conveyor 16 carries the blanks to an inclined main conveyor 18, and the blanks travel along the main conveyor 18 to its downstream end 20 where they are discharged into a hopper 22.

After the blanks are discharged from the downstream end 20 of the main conveyor 18, they impact against a backstop 24 and fall either a) directly onto a discharge conveyor 28 or b) onto elevating fingers 26 which controllably lower stacks of the blanks onto the discharge conveyor 28. As the stack 30 on the elevating fingers 26 grows, the elevating fingers 26 drop, either continuously or periodically, so that the sheets leaving the main conveyor 18 are always falling approximately the same distance from the downstream end 20 onto the elevating fingers 26 or onto the partial stack 30 on the discharge conveyor 28. In other embodiments, the sheets may fall on a fixed height platform or conveyor, and the downstream end 20 of the main conveyor 18 may rise to stay a relatively fixed distance above the top of the growing stack 30.

When the stack 30 has reached a desired height, the elevating fingers 26 lower the stack 30 to a level even with the discharge conveyor 28, if elevating fingers 26 are used, and the discharge conveyor 28 moves the finished stack 30 away from the stacking apparatus 10. When the stack 30 has been transferred from the elevating fingers (or when the stack has moved away from the location beneath the hopper 22 if the stack was formed directly on the discharge conveyor 28), the elevating fingers 26 rise toward the hopper 22 to receive additional sheets from the downstream end 20 of the main conveyor 18.

The rotary die cut machine 12 operates substantially continuously, and sheets of material therefore continue to traverse the stacking apparatus 10 and reach the hopper 22 even when a finished stack is being removed from the discharge conveyor 28 and/or when the elevating fingers 26 are lowering the stack 30 toward the discharge conveyor 28. During the time that the stack 30 is being removed from beneath the hopper 22, accumulator shelves 32 are extended to receive sheets as they leave the downstream end 20 of the main conveyor 18. When a finished stack has been removed from beneath the hopper 22 and the elevating fingers 26 are back in position for receiving additional sheets, the accumulator shelves 32 retract and drop the sheets that have accumulated thereon onto the elevating fingers 26 or onto the discharge conveyor 28. Additional sheets exiting the downstream end 20 of the stacking apparatus 10 fall onto the stack, and the process repeats until the stack on the elevating fingers 26 or the discharge conveyor 28 reaches a desired height.

It is common to include a tamping device in the hopper 22. Such a tamping device repeatedly presses in against the stack on the accumulator shelves 32—either from one or both sides or from the front and/or back, to align or square the small stack on the accumulator shelves 32. It is often desirable to finish squaring or tamping the stack on the accumulator shelves 32 before withdrawing the accumulator shelves 32 and dropping the small stack onto the elevating fingers 26 or the discharge conveyor 28.

Modern rotary die cut machines and stackers operate at increasingly high speeds, and the number of sheets transported per minute is thus increasing. To maintain a high throughput, it is desirable to keep the rotary die cut machine and the stacker operating continuously. However, with present stacker designs, it is difficult or impossible to finish tamping a small stack of sheets on the accumulator shelves and drop that small stack from the accumulator before the next sheets start to fall from the end of the main conveyor. This is particularly true when the stackers employ a blowing device to cause the sheets exiting the discharge end of the main conveyor to fall faster than they would under the force of gravity alone, particularly in the case of large sheets that tend to float on a cushion of air as they drop. In such devices, it is difficult or impossible to consistently time accumulator operation so that a laterally extendable accumulator shelf can be inserted into a falling stack of sheets without either damaging the edges of the sheets or possibly causing a jam.

SUMMARY

These problems and others are addressed by embodiments of the present disclosure, a first aspect of which comprises a sheet stacking system that includes a conveyor configured to carry sheets from a conveyor intake end to a conveyor discharge end and a hopper at the discharge end configured to receive the sheets ejected from the discharge end of the conveyor and guide the sheets as they fall in a cascade path onto a platform associated with the hopper. The falling sheets form a main stack on the platform. The hopper includes a backstop facing the discharge end of the conveyor such that the sheets ejected from the discharge end impact against the backstop before forming the main stack, and hopper includes a first accumulator made up of a carrier and at least one first support that extends from the carrier through the backstop. The at least one first support is configured to rotate from a retracted position to an extended position relative to the backstop. The carrier is movable linearly and vertically relative to the backstop with the at least one first support in the extended position from a raised location with the at least one first support outside the cascade path to a lowered location with the at least one first support in the cascade path.

Another aspect of the disclosure comprises a sheet stacking system that includes a conveyor configured to carry sheets from a conveyor intake end to a conveyor discharge end and a hopper at the discharge end configured to receive the sheets ejected from the discharge end of the conveyor and guide the sheets as they fall in a cascade path onto a platform associated with the hopper. The falling sheets forming a main stack on the platform. The hopper includes a backstop having a first side facing the discharge end of the conveyor and a second side opposite the first side, and the backstop is positioned such that the sheets ejected from the discharge end impact against the first side of the backstop before forming the main stack. The hopper also includes a first accumulator, and the first accumulator includes a support shaft rotatably mounted at the second side of the backstop and a plurality of first wheels mounted on the support shaft for rotation with the support shaft. Each of the first wheels has an axis of rotation. The first accumulator also includes a plurality of second wheels mounted at the backstop, and each of the plurality of second wheels has an axis of rotation parallel to the axes of rotation of the plurality of first wheels. The first accumulator also includes a plurality of belts, and each belt of the plurality of belts extends from one of the plurality of first wheels to one of the plurality of second wheels. The accumulator further includes a rotary actuator connected to a first one of the plurality of belts, a drive shaft extending from the rotary actuator, and a plurality of first supports mounted to the drive shaft for rotation therewith. The rotary actuator is configured to rotate the drive shaft from a first position in which the plurality of first supports extend through the backstop into the cascade path and a second position in which the plurality of first supports are located outside the cascade path. The accumulator also has a linear actuator connected to the rotary actuator that is configured to move the rotary actuator and the drive shaft in a first direction and a second direction relative to the second side of the backstop.

Yet another aspect of the present disclosure comprises a sheet stacking system that includes a conveyor configured to carry sheets from a conveyor intake end to a conveyor discharge end and a hopper at the discharge end configured to receive the sheets ejected from the discharge end of the conveyor and guide the sheets as they fall in a cascade path onto a platform associated with the hopper. The falling sheets form a main stack on the platform. The hopper has a backstop with a first side facing the discharge end of the conveyor and a second side opposite the first side, and the backstop is positioned such that the sheets ejected from the discharge end impact against the first side of the backstop before form the main stack. The hopper includes a first accumulator that has a plurality of first supports shiftable between a first position in which the plurality of first supports extend through the backstop into the cascade path and a second position in which the plurality of first supports are located outside the cascade path, and a mechanism for shifting the plurality of first supports from the first position to the second position, and a mechanism for moving the plurality of first supports linearly and vertically relative to the backstop.

DETAILED DESCRIPTION

Figure 1:
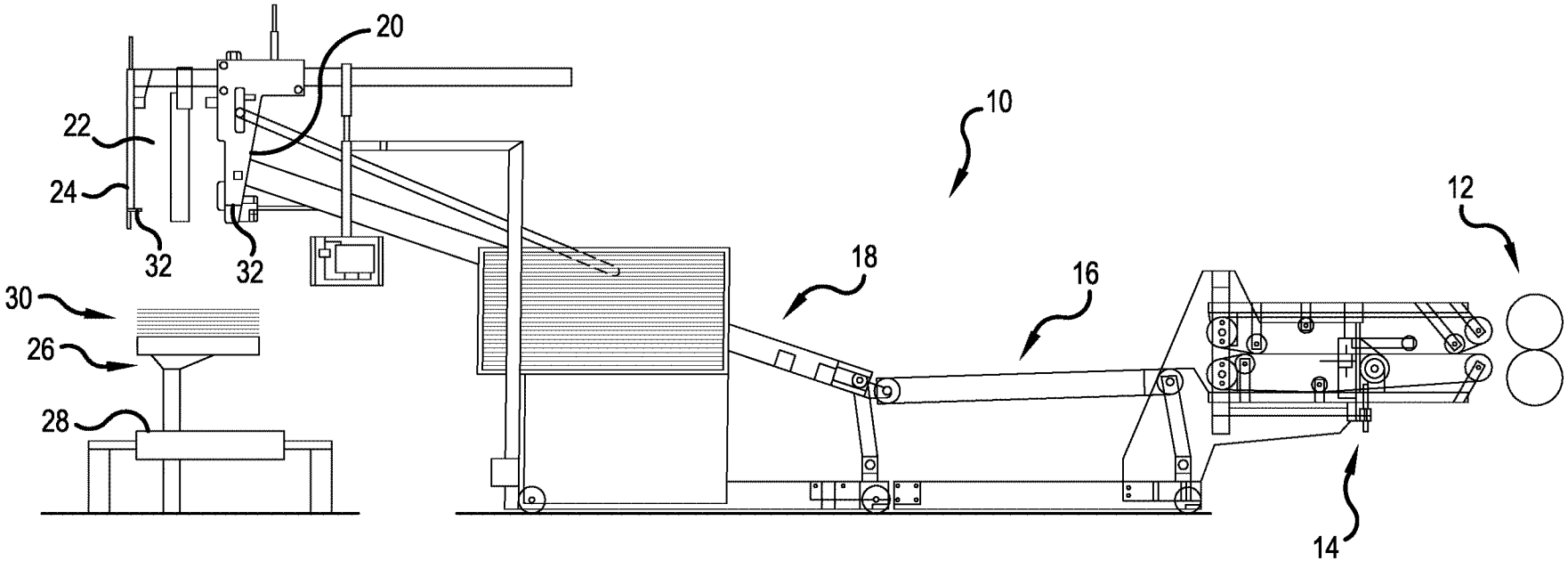
FIG.1 CONVENTIONAL ART
FIG. 1 is a schematic elevational view of a conventional rotary die cut machine and a conventional stacking system.
Figure 2:
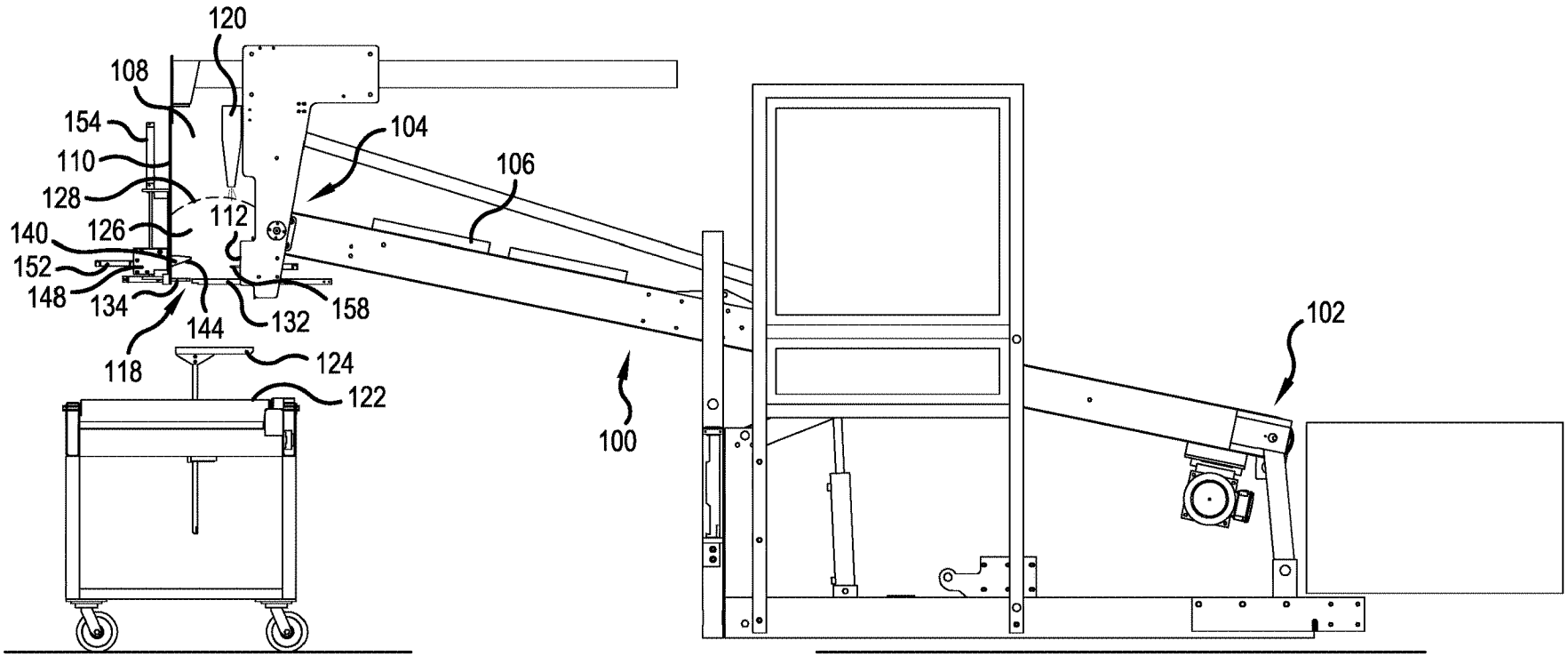
FIG. 2 is a schematic elevational view of a rotary die cut machine and a stacking system according to an embodiment of the present disclosure.
Figure 8:
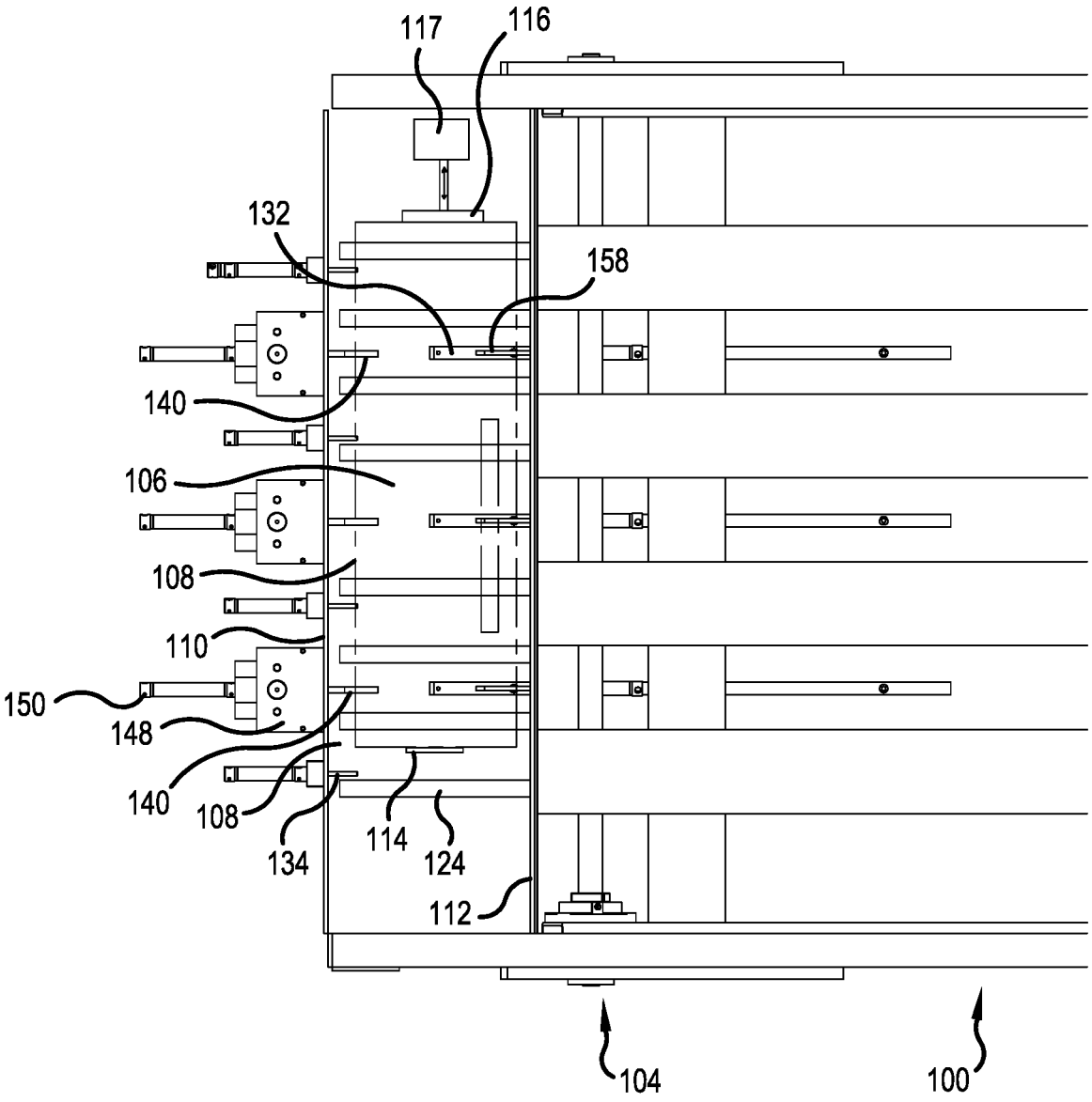
FIG. 8 is a top plan view of the discharge end of the stacking system of FIG. 2.
Figure 9:
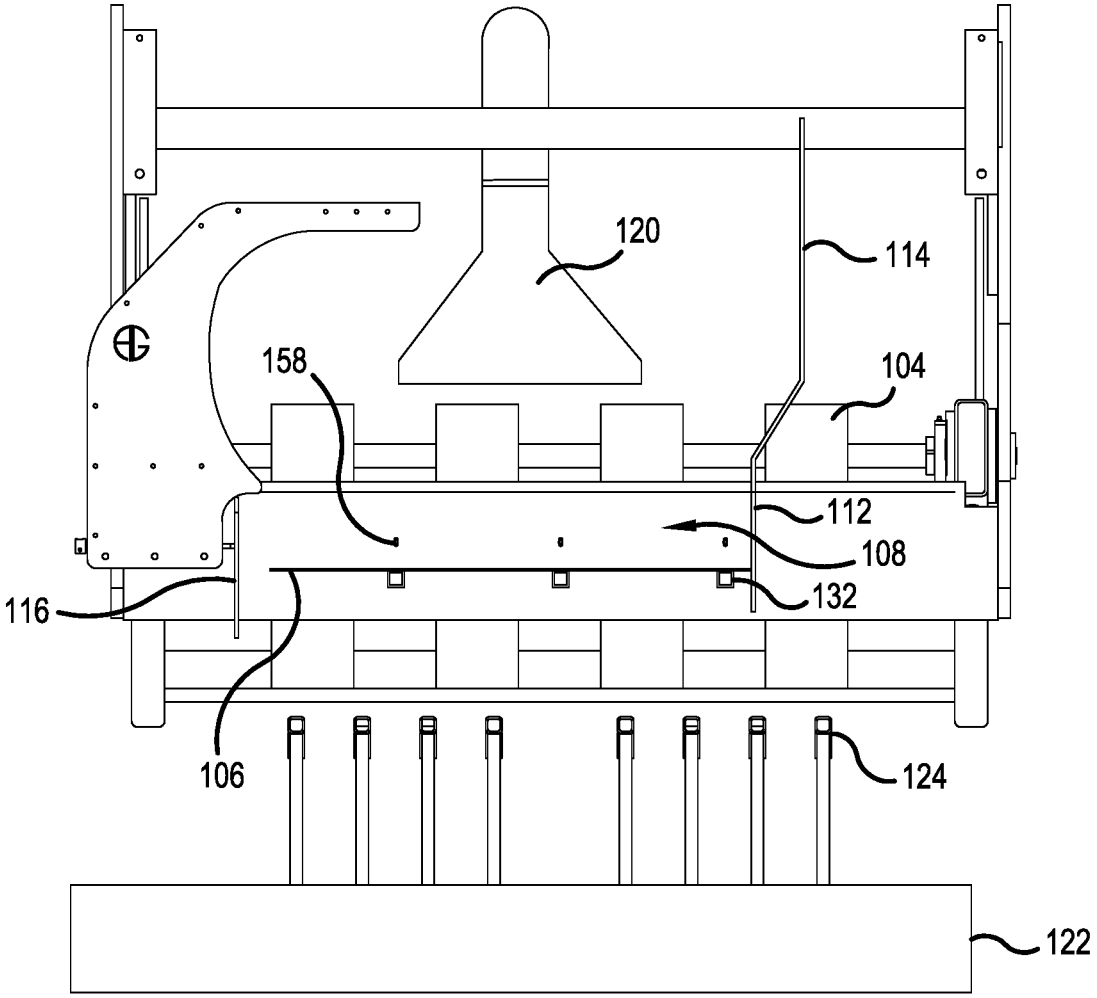
FIG. 9 is an end elevational view of the stacking system of FIG. 2 with the backstop removed for illustration purposes.

Referring now to the drawings, wherein the showings are for purposes of illustrating embodiments of the disclosure only and not for the purpose of limiting same, FIG. 2 shows a main conveyor 100 having an intake end 102 and a discharge end 104 which is configured to carry sheets 106 in a sheet travel direction (sometimes referred to as a "downstream" direction) from the intake end 102 toward the discharge end 104. As the sheets 106 reach the discharge end 104, they are ejected into a hopper 108 which hopper 108 comprises, among other elements discussed hereinafter and best illustrated in FIG. 8, a backstop 110, a front wall 112, a fixed side guide 114, a movable side guide 116, and a bottom opening 108. The movable side guide 116 and an actuator 117 form a tamper for tamping or squaring stacks of sheets in the hopper 108.

The forward edges of the sheets 106 leaving the discharge end 104 of the main conveyor 100 begin to drop under the force of gravity and, optionally, the force of a downward flow of air produced by a blower 120. The downstream motion of each sheet 106 is arrested when the sheet 106 impacts against the backstop 110. This occurs at approximately the same time a trailing edge of the sheet 106 passes the discharge end 104 of the main conveyor 100, and each sheet 106 thus falls under the force of gravity, and optionally the force of the air flow produced by the blower 120, toward a receiving device which may comprise, for example, a conventional discharge conveyor 122 or elevating fingers 124. The present embodiment includes elevating fingers 124; however, persons of ordinary skill in the art will understand that the elevating fingers 124 could be omitted, for example, if the discharge end 104 of the main conveyor 100 can be raised during conveyor operation. The function of the hopper 108 remains substantially the same whether or not the elevating fingers 124 are used.

The sheets 106 are ejected substantially continuously from the discharge end 104 of the main conveyor 100 and form a cascade of sheets that travel along what is referred to herein as a "cascade path" 126. This cascade path 126 comprises the volume through which the sheets 106 pass between the discharge end 104 of the main conveyor 100 and the elevating fingers 124 or other receiving device. Much of the cascade path 126 is defined by the elements of the hopper 108, namely, the backstop 110, the front wall 112, the fixed side guide 114 and the movable side guide 116.

Figure 3:
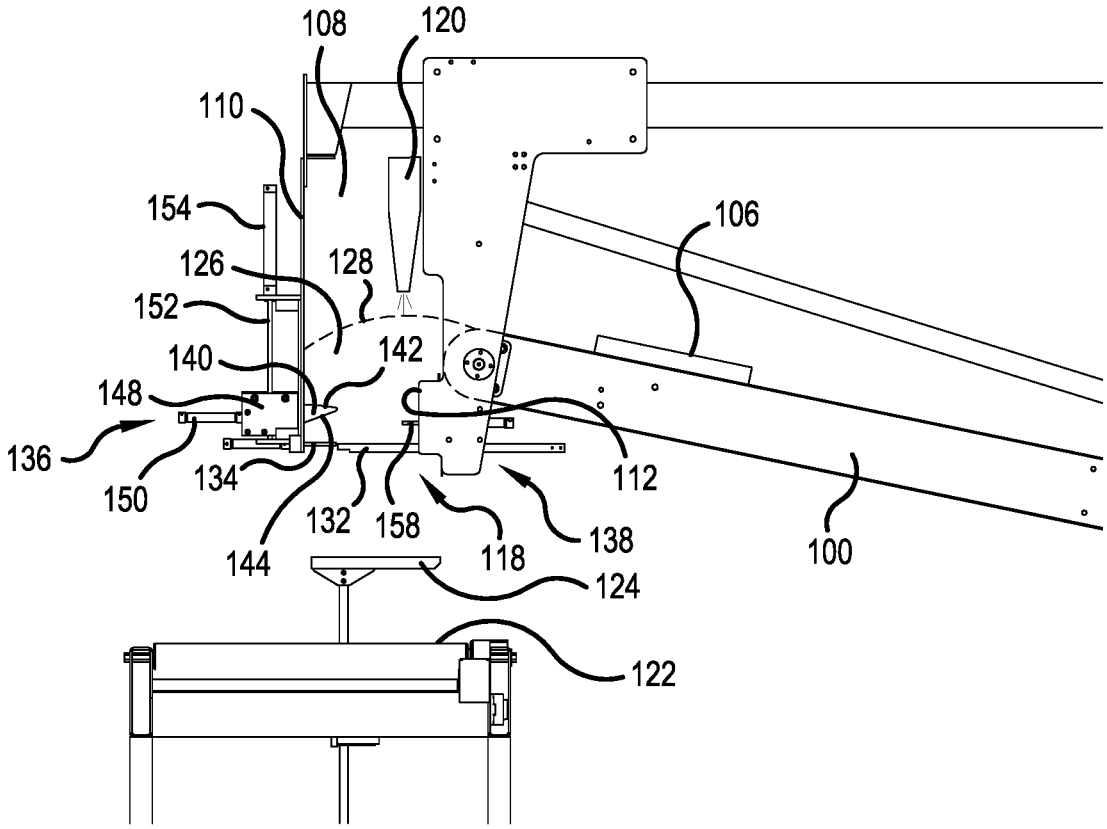
FIG. 3 is a detail view of the discharge end of the stacking system of FIG. 2.
Figure 5:
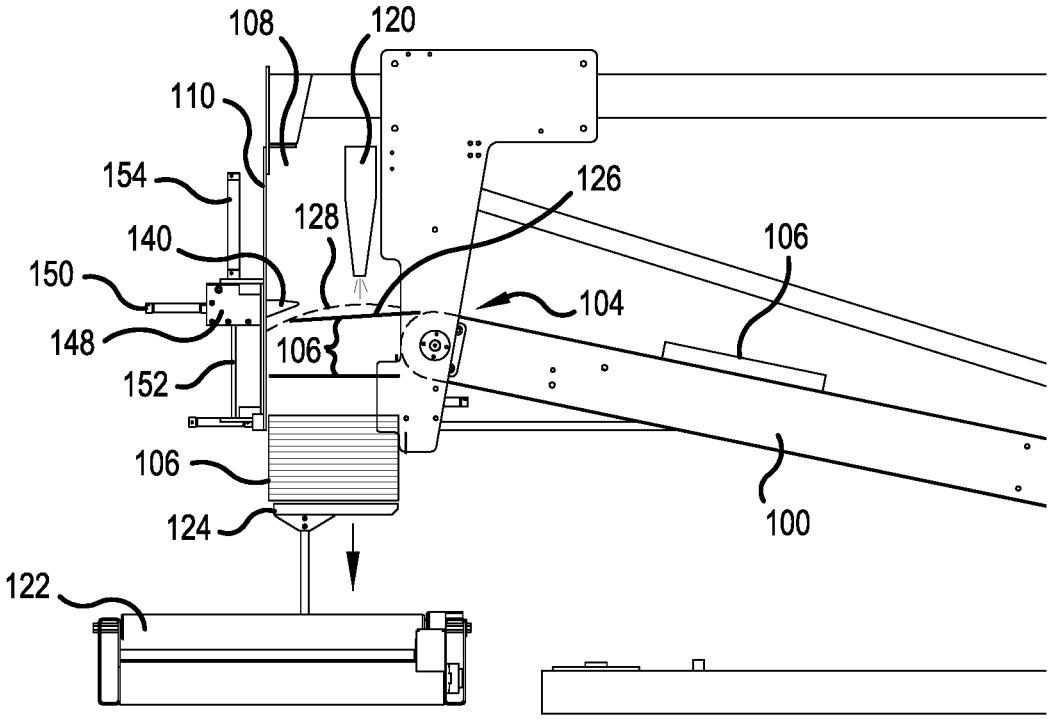

Because the leading edges of the sheets 106 begin to drop toward the elevating fingers 124 before the trailing edge of the sheets 106 pass the discharge end 104, the upper edge 128 of the cascade path 126, shown by a dashed line in FIGS. 3 and 5, curves and meets the backstop 110 at a location that is lower than the discharge end 104 of the main conveyor 100.

If nothing obstructs the cascade path 126, the sheets leaving the discharge end 104 of the main conveyor 100 will land on the elevating fingers 124, or on sheets 106 that were previously deposited on the elevating fingers 124, and form a stack. The elevating fingers 124 are configured to lower stacks of the sheets 106 onto the discharge conveyor 122 so that the discharge conveyor 122 can move the finished stacks transverse to the downstream direction and away from the bottom opening 118 of the hopper for further processing. However, the flow of sheets 106 leaving the discharge end 104 of the main conveyor 100 does not stop while the elevating fingers 124 and the discharge conveyor 122 are removing finished stacks of the sheets 106. It is therefore necessary to provide at least one accumulator for catching and retaining falling sheets 106 until the elevating fingers 124 are back in position to receive the sheets 106 falling from the bottom opening 118 of the hopper 108.

The hopper 108 includes an accumulator shelf 132 that is shiftable between retracted and extended positions relative to the front wall 112 of the hopper 108 and accumulator pins 134 that are shiftable between retracted and extended positions relative to the backstop 110 of the hopper 108. It is known from the prior art to use an accumulator shelf to catch falling sheets while a finished stack is removed from below a hopper. However, as the speeds at which the rotary die cut machine and the main conveyor 100 increase, and especially when the blower 120 is used to make the sheets 106 fall through the hopper 108 faster than they would under the force of gravity alone, it becomes increasingly difficult to time the operation of an accumulator shelf so that it extends into a space between two falling sheets 106 rather than impacting the edge of a falling sheet and causing a jam.

To address this problem, the disclosed stacking system includes a novel accumulator 136 that may be used alone or together with another accumulator 138. The novel accumulator may be referred to hereinafter as the "first" accumulator and other accumulator as a "second" accumulator even though it is not always necessary to provide the second accumulator 138.

A first embodiment of the first accumulator 136 is described below.

The first accumulator 136 comprises a plurality of first supports 140 that are configured to be selectably and controllably extended and retracted relative to the backstop 110. To this end, the backstop 110 may be formed from a unitary sheet of material having a plurality of parallel slots (not illustrated) or, alternately, formed as a plurality of closely spaced strips of material separated by elongated gaps through which the first supports 140 can project.

Figure 7:
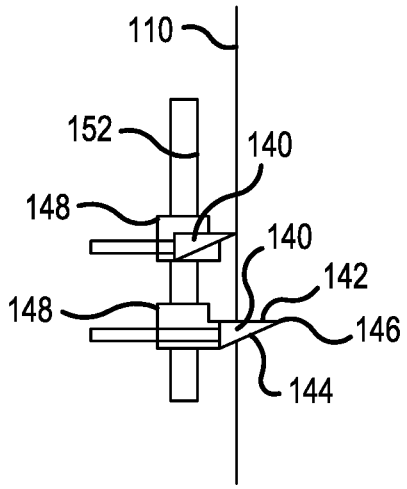
FIG. 7 is a schematic side elevation view of the interrupt fingers of the stacking system of FIG. 2 shown in extended and retracted positions.

Each of the first supports 140 has a generally horizontal top surface 142 (see FIG. 7) and an angled lower surface 144 that meets the top surface 142 at an acute angle at a tip 146. Each of the first supports 140 is slidably mounted in a housing 148 located on the opposite side of the backstop 110 from the main conveyor 100, which housing 148 also supports a horizontal actuator 150, which may comprise a pneumatic cylinder, for example. The horizontal actuator 150 is configured to extend in order to slide the first support 140 through the backstop 110 to an extended position and to retract to pull the first support 140 back into the housing 148 into a retracted position. FIG. 7 illustrates the first support 140 in the extended position and the retracted position; two configurations of the first support 140 are shown in two housings 148 on a single vertical shaft 152 for illustration purposes. Only one housing 148 is provided on each vertical shaft 152 in actual embodiments.

Figure 4:
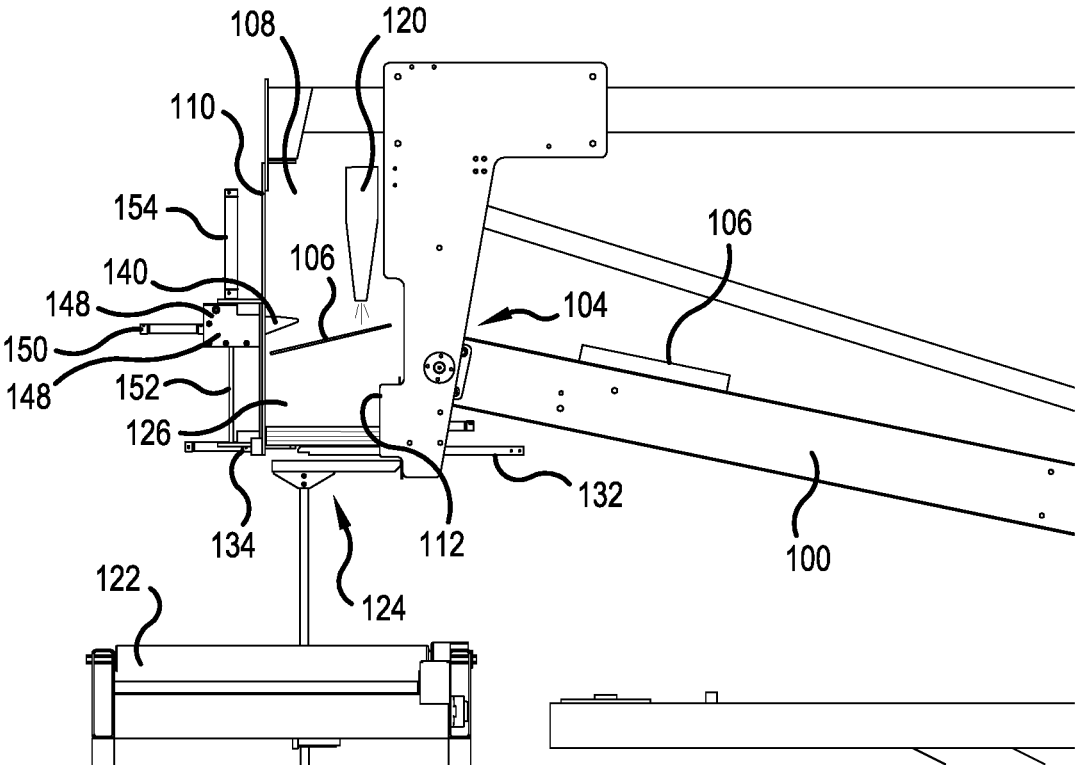
FIGS. 4-6 illustrate the formation of a stack at the discharge end of the stacking system of FIG. 2.

The housing 148 is also mounted for vertical sliding movement on the vertical shaft 152 under the control of a vertical actuator 154, another pneumatic cylinder, for example, for sliding movement between a raised location, illustrated in FIGS. 4 and 5, and a lowered location illustrated in FIGS. 2 and 3. The horizontal actuator 150 and the vertical actuator 154 are independently controllable by a suitable controller, which may comprise, for example, a microprocessor or a PLC, preferably the controller that controls other operations of the overall stacking system.

The first accumulator 136 also includes a plurality of second supports 158, in this case, a plurality of pins 158, that are configured to move between an extend position and a retracted position relative to the front wall 112 of the hoper 108. The pins 158 are vertically fixed and are located at the approximate level of the lowered location of the first supports 140. That is, when the first supports 140 are in the extended position at the lowered location and the pins 158 are in the extended position, the top surfaces 142 of the first supports 140 and the pins 158 support sheets 106 in the hopper 108 in a substantially horizontal orientation.

When the second supports 158 are in the retracted position, they are located outside the cascade path 126, and when the second supports 158 are in the extended position they extend into the cascade path 126. When the first supports 140 are in the retracted position, they are located outside the cascade path 126. When the first supports 140 are in the extended position, they are located outside the cascade path 126 when they are at the raised location and they are located in the cascade path 126 when they are at the lowered location.

The operation of the disclosed stacking system will now be described with reference to FIGS. 4-6. The operation of the second embodiment of the stacking system illustrated in FIGS. 10-13 will also become clear from the disclosed operation of the first embodiment.

In FIG. 4, the elevating fingers 124 are raised to a location near the bottom opening 118 of the hopper 108 and in position to receive sheets 106 from the hopper 108. The sheets 106 are supported by the accumulator shelf 132 and the pins 134 of the second accumulator 138, and additional sheets 106 are falling onto the partial stack on the second accumulator 138. The partial stack is also being tamped at this time by the action of the actuator 117 repeatedly pressing the movable side guide 116 against sheets 106 on the partial stack to square them against the fixed side guide 114. Because the elevating fingers 124 are in position to receive additional sheets 106, having just deposited a previous stack of sheets 106 on the discharge conveyor 122, for example, the controller causes the accumulator shelf 132 and the pins 134 to retract and drop the partial stack of sheets 106 onto the elevating fingers 124.

FIG. 5 shows the partial stack of sheets 106 supported on the elevating fingers 124 after being dropped from the second accumulator 138. The main conveyor 100 continues to eject sheets 106 from the discharge end 104 into the hopper 108, and the blower 120 moves the sheets 106 along the cascade path 126 to the top of the growing partial stack of sheets 106 on the elevating fingers 124. At this time, the elevating fingers 124 are lowered such that each of the sheets 106 falling from the discharge end 104 of the main conveyor 100 falls approximately the same distance onto the top of the growing partial stack.

When the partial stack has reached a desired size, the elevating fingers 124 must be lowered to place the now-finished stack on the discharge conveyor 122. However, because of the rapid rate at which the sheets 106 traverse the cascade path 126 and the small spacing between adjacent ones of the sheets 106, it is not practical to extend the accumulator shelf 132 and pins 134 of the second accumulator 138 into the cascade path 126. This is because it is likely that either the accumulator shelf 132 or the pins 134 will impact a side of one of the sheets 106 and misalign the sheets 106 in a manner that interferes with efficient stack formation and/or causes a jam that requires the rotary die cut machine and the main conveyor 100 to be stopped while the jam is cleared.

To avoid such a problem, the first accumulator 136 is actuated as follows. During the process of forming a partial stack on the second accumulator 138 and later on the elevating fingers 124, the first supports 140 of the first accumulator 136 have been in the raised location and the extended position (See FIGS. 4 and 5), and the pins 158 of the first accumulator 136 have been in the retracted position. The tips 146 of the first supports 140 are located outside the cascade path 126 as shown in FIGS. 4 and 5 because the leading edges of the sheets 106 drop under the forces of gravity and the airflow from the blower 120. The pins 158 are also retracted and located outside the cascade path 126 such that they do not interfere with the flow of sheets 106 along the cascade path 126 and through the hopper 108.

Figure 6:
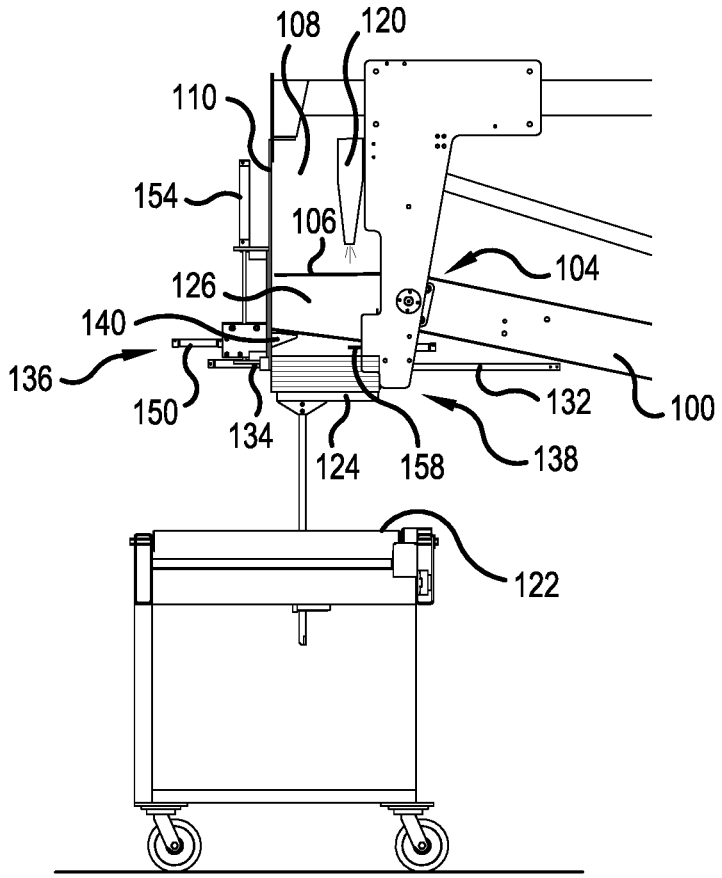

In order to interrupt the flow of the cascading sheets 106, the vertical actuator 154 is fired to rapidly drive the housing 148 downwardly and this moves the first support 140 downwardly into the lowered position illustrated in FIG. 6. This lowering takes place very quickly, on the order of a tenth of a second, and such that is appears substantially instantaneous to an observer. As the first support 140 travels in the downward direction, its angled lower surface 144 crosses the upper edge 128 of the cascade path 126 and enters into the cascade path 126. Because the sheets 106 at the location where the first support 140 enters the cascade path 126 tend to be oriented with their leading edges tipping downwardly, it is likely that an incoming sheet 106 will come into contact the first support 140 in one of two ways, neither of which will lead to a jam.

First, if the vertical actuator 154 fires when a sheet 106 is in the location illustrated in FIG. 5, with the leading edge of the sheet 106 below the angled lower surface 144 of the first support 140, the downward movement of the first support 140 will drive the angled lower surface 144 of the first support 140 into contact with the top of the sheet 106 and press the sheet 106 downwardly toward the stack forming on the elevating fingers 124. Alternately, if the vertical actuator 154 fires before the leading edge of the sheet 106 has reached a position beneath the angled lower surface 144, the first support 140 will reach the lowered location of FIG. 6 before the most recently ejected sheet 106 and it will be in position to receive the incoming sheet 106 on the horizontal top surface 142 thereof.

Because the angle of the angled lower surface 144 and the orientation of the sheets 106 exiting the discharge end 104 of the main conveyor 100, and the speed at which the first support 140 is moved from the raised location to the lowered location by the vertical actuator 154, it is nearly impossible to create a jam between an incoming sheet 106 and the tip 146 of the first support 140.

The pins 158 of the first accumulator 136 are shifted to the extended position at approximately the same time the first support 140 reaches the lowered location. Because of the manner in which the sheets 106 fall from the discharge end 104 of the main conveyor, larger gaps exist between the trailing edges of the falling sheets along the hopper front wall 112. It is therefore generally easier to time the movement of the pins 158 so that they do not impact against an edge of a falling sheet 106.

The first accumulator 136 then accumulates several sheets 106 while a final tamping is performed on the stack of sheets 106 on the elevating fingers 124, and the elevating fingers 124 drop from the position illustrated in FIG. 6 to place the finished stack of sheets 106 onto the discharge conveyor 122. Once the top of the stack of sheets 106 on the elevating fingers 124 has cleared the bottom opening 118 of the hopper 108, the accumulator shelf 132 and the pins 134 of the second accumulator 138 are shifted from their retracted positions to their extended positions. Because the incoming sheets are at this time still being caught by the first accumulator 136, there is no danger of driving the edge of the accumulator shelf 132 into the edge of a falling sheet 106 and there is no need to precisely time the shifting of the second accumulator to the extended position.

With the second accumulator 138 in position, the pins 158 of the first accumulator 136 are retracted and the first supports 140 of the first accumulator 136 are retracted by the horizontal actuator 150. With the first supports 140 including their tips 146 completely out of the cascade path 126, the vertical actuator 154 shifts the housing 148 back to the raised location and the horizontal actuator 150 shifts the first supports 140 into the extended position of FIG. 4 at which point the cycle repeats.

A second embodiment of the first accumulator 136, referred to as the first accumulator 200, is described below with reference to FIGS. 10-14. This embodiment is generally similar to the first embodiment except for the structure of the first supports and the actuator mechanism for raising, lowering, extending and retracting the first supports.

FIGS. 10-13 show the backstop 110 from the rear, the side outside the hopper 108. A plurality of parallel vertical slits 202 in the backstop 110 are visible in these drawings. As illustrated in the exploded view of FIG. 11, the first accumulator 200 includes a pivot section 204 and a lift section 206, each of which is discussed below.

The pivot section 204 includes a support rod 208 formed from a plurality of individual rod sections 210, 212, 214 interconnected such that they rotate together and a plurality of fingers 216 affixed to the rod sections 210, 212, 214 such that they rotate with the support rod 208. First and second rotary actuators 218 are connected to the outer ends of the rod 208, and a first mounting block (or bearing block) 219 is connected between the first rod section 210 and the second rod section 212 and a second mounting block (or bearing block) 219 is connected between the second rod section 212 and the third rod section 214. The rotary actuators 218 are configured to rotate the rod 208 approximately 90 degrees to shift the fingers 216 between an extended position and a retracted position relative to the backstop 110 as discussed below.

The lift section 206 includes a plurality of upper brackets 220 and a plurality of lower brackets 222 extending from the rear of the backstop 110 generally above and below, respectively, opposite ends of the slits 202. First, second and third horizontal slot plates 226, 228, 230 extend between adjacent pairs of the lower brackets 222 and are located beneath, respectively, each of the first, second and third rod sections 210, 212, 214. The first, second and third slot plates 226, 228, and 230 each have a plurality of slots 232 that align with the slots 202 in the backstop 110.

Adjacent pairs of the lower brackets 222 each rotatably support a lower gear wheel 234. An upper support shaft 236 is supported by the upper brackets 220 and a plurality of upper gear wheels 238, vertically aligned with the lower gear wheels 234, are mounted on the upper support shaft 236 for rotation therewith. A timing belt 240 is connected between vertically aligned pairs of the lower and upper gear wheels 234, 238, and each timing belt 240 includes a mounting plate 242 thereon for attaching elements, discussed below, to the timing belts 240.

First and second pneumatic actuators 244 are mounted to the backstop 110 at either end of the upper support shaft 236.

The rotary actuators 218 are connected to the mounting plates 242 of the outer timing belts 240, and the mounting blocks 219 are connected to the mounting plates 242 of the inner timing belts 240. The pneumatic actuators 244 are attached to the mounting plates 242 of the outer timing belts 240 as well. The fingers 216 are aligned with the slots 202.

Figure 10:
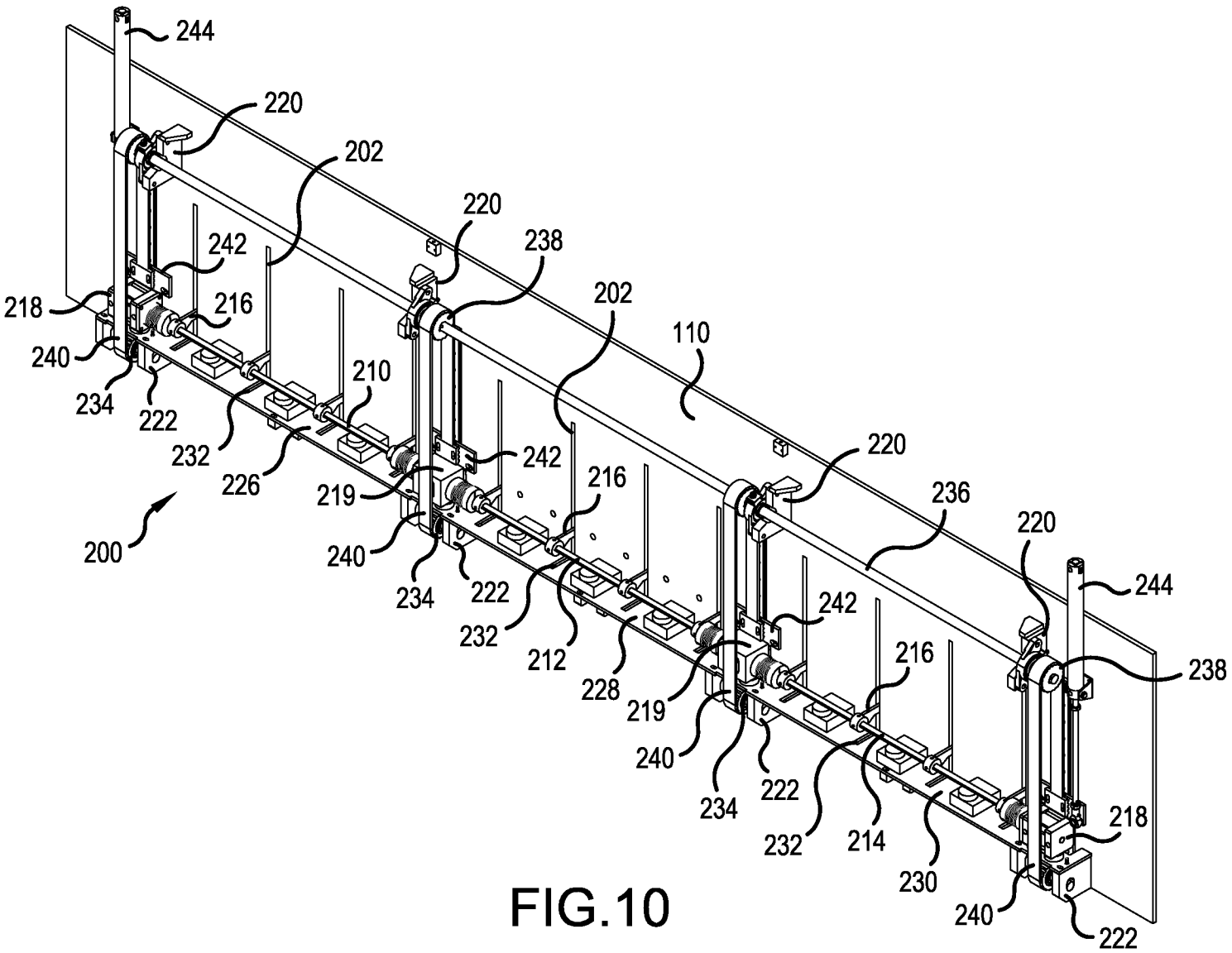
FIG. 10 is a rear perspective view of a second embodiment of the first accumulator.
Figure 11:
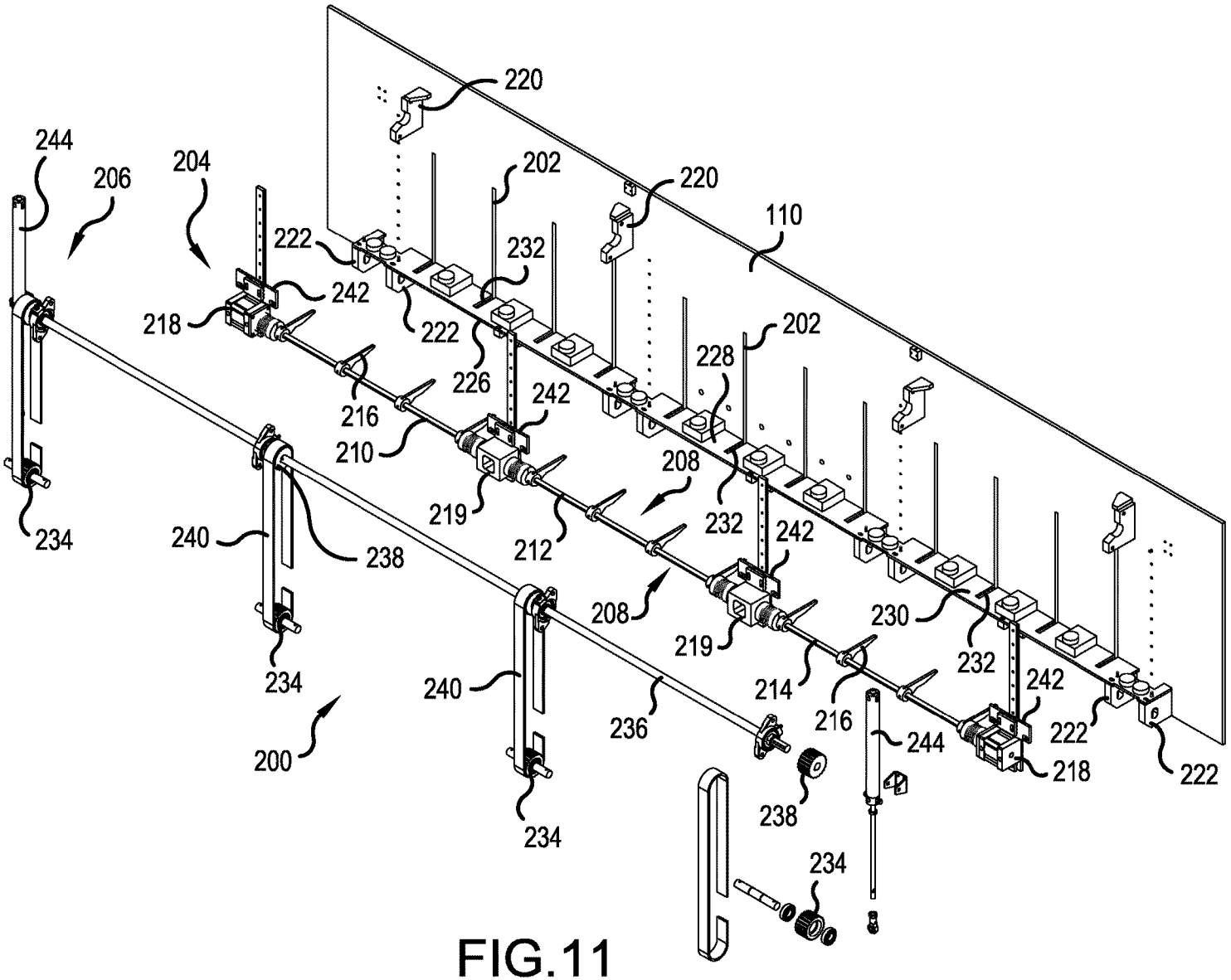
FIG. 11 is a first exploded perspective view of the first accumulator of FIG. 10.
Figure 12:
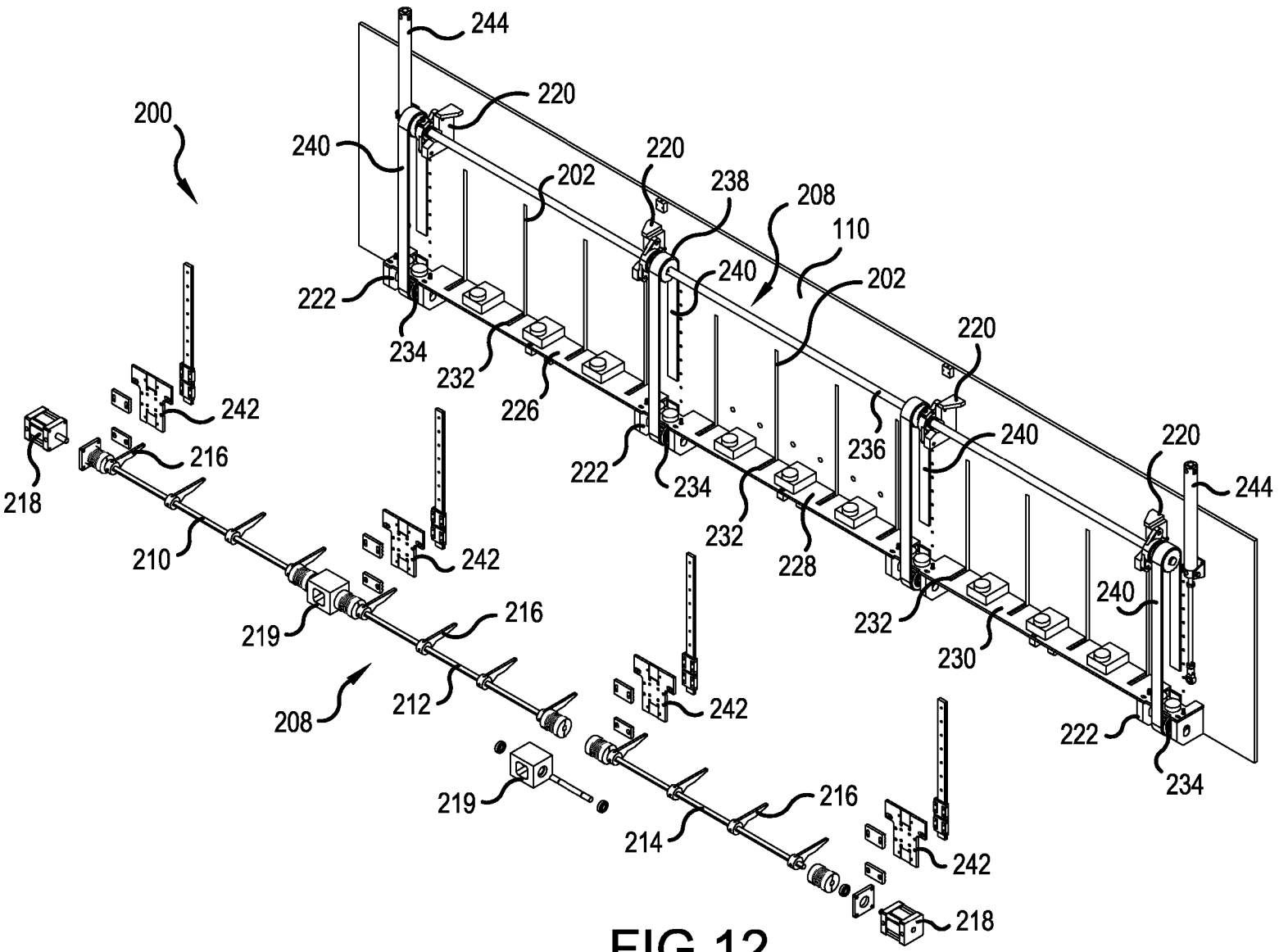
FIG. 12 is a second exploded perspective view of the first accumulator of FIG. 10.
Figure 13:
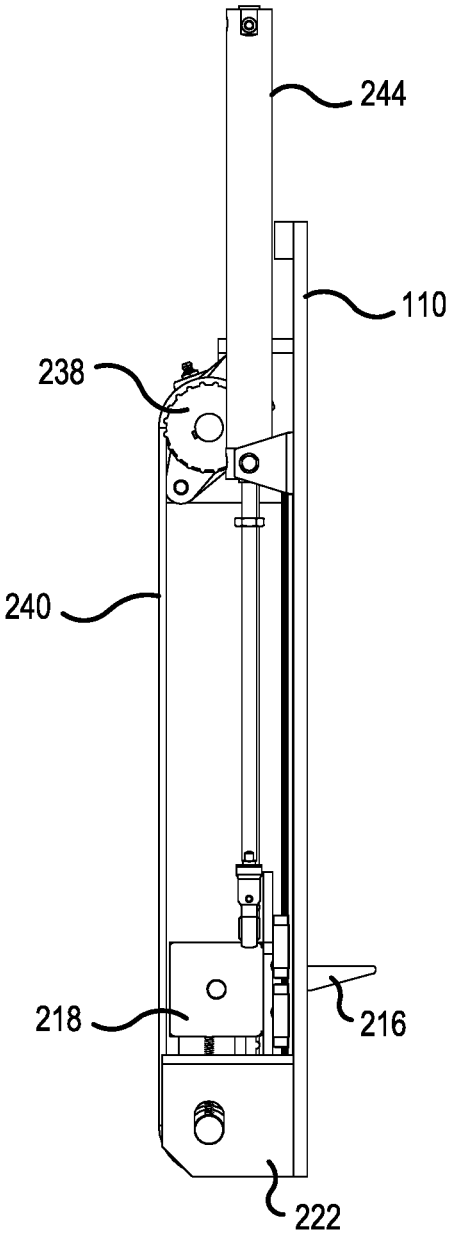
FIG. 13 is side elevational view of the first accumulator of FIG. 10.

It will be understood from the assembled state of the accumulator 200 illustrated in FIG. 10 that the pneumatic actuators 244, under the control of the system controller, raise and lower the pivot section 204. The pneumatic actuators 244 are shown in the extended position in FIG. 10, and the fingers 206 are shown in a first position extending through the slots 202 in the backstop 110. As the pneumatic actuators 244 raise and lower the pivot section 206, the timing belts ensure that all the mounting plates 242 and thus all fingers 206 rise and fall at the same time.

In operation, the accumulator 200 starts in a raised position (not illustrated but similar to the position of the supports in the first embodiment illustrated in FIG. 4) with the fingers 206 projecting though the slots 202 in the backstop 110. The pneumatic actuators are then lowered to a bottom position and the rotary actuators are caused to rotate the tips of the fingers 206 ninety degrees (upward or downward) so that the fingers 206 extend through the slots 232 in the slot plates 226, 228, and 230. With the fingers 206 held completely to one side of the backstop 110 (or at least at a position such that no portion extends into the hopper 108), the pneumatic actuators 244 then lift the pivot section 204 to a raised position, and the rotary actuators 218 cause the fingers 206 to pivot ninety degrees to their starting positions, extending through the backstop 110. The timing of the extending and retracting and raising and lowering of the fingers 206 is carried out in the same manner described above in connection with the first embodiment.

The present invention has been described herein in terms of a preferred embodiment. However, modifications and additions to this disclosure will become apparent to those of ordinary skill in the art upon a reading of the foregoing detailed description. For example, while the stacking system of the disclosed embodiment includes first and second accumulators, it is possible to use the disclosed first accumulator as the only accumulator in a stacking system. It is intended that all such additions and modifications form a part of the present invention to the extent they fall within the scope of the several claims appended hereto.

What is claimed is:

1. A sheet stacking system comprising:

a conveyor configured to carry sheets from a conveyor intake end to a conveyor discharge end;

a hopper at the discharge end configured to receive the sheets ejected from the discharge end of the conveyor and guide the sheets as they fall in a cascade path onto a platform associated with the hopper, the falling sheets forming a main stack on the platform, the hopper including a backstop having a first side facing the discharge end of the conveyor such that the sheets ejected from the discharge end impact against the backstop first side before forming the main stack, and a first accumulator comprising a carrier, at least one first support extending from the carrier through the backstop, and an actuator configured to rotate the at least one first support from a retracted position to an extended position relative to the backstop, the carrier and the first support being movable vertically in a linear manner relative to the backstop with the at least one first support in the extended position from a raised location with the at least one first support outside the cascade path to a lowered location with the at least one first support in the cascade path, wherein the carrier comprises a shaft and the at least one first support comprises a plurality of first supports extending from the shaft and fixed to the shaft for rotation therewith.

2. The sheet stacking system according to claim 1, wherein the first accumulator is mounted on and supported by the backstop.

3. The sheet stacking system according to claim 2, wherein the carrier is movable from the raised location to the lowered location when the at least one first support is in the extended position and is movable from the lowered location to the raised location when the at least one support is in the retracted position.

4. The sheet stacking system according to claim 3, including at least one second support below the conveyor discharge end configured to shift between a retracted position outside the cascade path and an extended position in the cascade path, the at least one second support being located substantially horizontally across the hopper from the at least one first support when the carrier is in the lowered location.

5. The sheet stacking system according to claim 4, wherein the hopper includes a front wall facing and spaced from the backstop and at least partially defining the cascade path and wherein the at least one second support is located at the front wall.

6. The sheet stacking system according to claim 5 including a blower configured to blow air from above the cascade path toward the platform.

7. The sheet stacking system according to claim 1, wherein the actuator comprises a rotary actuator.

8. The sheet stacking system according to claim 1, wherein the backstop has a second side opposite the first side, wherein the first accumulator includes a first wheel and a second wheel mounted on the second side of the backstop and a belt supported by the first wheel and the second wheel, wherein the carrier is connected to the belt for movement therewith, and including a linear actuator mounted on the backstop and connected to the carrier and configured to move the carrier linearly and vertically relative to the backstop and to move the belt to rotate the first wheel and the second wheel.

9. The sheet stacking system according to claim 1, including a linear actuator connected to the backstop and to the carrier and configured to move the carrier linearly and vertically relative to the backstop.

10. A sheet stacking system comprising:

a conveyor configured to carry sheets from a conveyor intake end to a conveyor discharge end;

a hopper at the discharge end configured to receive the sheets ejected from the discharge end of the conveyor and guide the sheets as they fall in a cascade path onto a platform associated with the hopper, the falling sheets forming a main stack on the platform, the hopper including a backstop having a first side facing the discharge end of the conveyor and a second side opposite the first side, the backstop being positioned such that the sheets ejected from the discharge end impact against the first side of the backstop before forming the main stack, and a first accumulator comprising:

a support shaft rotatably mounted at the second side of the backstop, a plurality of first wheels mounted on the support shaft for rotation with the support shaft, each of the first wheels having an axis of rotation, a plurality of second wheels mounted at the backstop, each of the plurality of second wheels having an axis of rotation parallel to the axes of rotation of the plurality of first wheels, a plurality of belts, each belt of the plurality of belts extending from one of the plurality of first wheels to one of the plurality of second wheels, a rotary actuator connected to a first one of the plurality of belts, a drive shaft extending from the rotary actuator, a plurality of first supports mounted to the drive shaft for rotation therewith, the rotary actuator being configured to rotate the drive shaft from a first position in which the plurality of first supports extend through the backstop into the cascade path and a second position in which the plurality of first supports are located outside the cascade path, and a linear actuator connected to the rotary actuator and configured to move the rotary actuator and the drive shaft in a first direction and a second direction relative to the second side of the backstop.

11. The sheet stacking system according to claim 10, wherein the drive shaft includes a plurality of drive shaft segments, a first one of the plurality of drive shaft segments having a first end connected to the rotary actuator and a second end supported by a bearing block connected to a second one of the belts.

12. The sheet stacking system according to claim 11, wherein the support shaft is supported by the backstop and the plurality of second wheels are supported by the backstop.

13. The sheet stacking system according to claim 12, including at least one second support below the conveyor discharge end configured to shift between a retracted position outside the cascade path and an extended position in the cascade path.

14. A sheet stacking system comprising:

a conveyor configured to carry sheets from a conveyor intake end to a conveyor discharge end;

a hopper at the discharge end configured to receive the sheets ejected from the discharge end of the conveyor and guide the sheets as they fall in a cascade path onto a platform associated with the hopper, the falling sheets forming a main stack on the platform, the hopper including a backstop having a first side facing the discharge end of the conveyor and a second side opposite the first side, the backstop being positioned such that the sheets ejected from the discharge end impact against the first side of the backstop before forming the main stack, and a first accumulator comprising:

a plurality of first supports shiftable between a first position in which the plurality of first supports extend through the backstop into the cascade path and a second position in which the plurality of first supports are located outside the cascade path, and means for shifting the plurality of first supports from the first position to the second position, and means for moving the plurality of first supports linearly and vertically relative to the backstop.

15. The sheet stacking system according to claim 14, wherein the means for shifting the plurality of first supports comprises a rotary actuator and the means for moving the plurality of first supports comprises a linear actuator.

* * * * *